US005342751A

United States Patent [19]

Nishiyama et al.

[11] Patent Number: 5,342,751

[45] Date of Patent: Aug. 30, 1994

[54] SILVER HALIDE PHOTOSENSITIVE MATERIAL

[75] Inventors: Shingo Nishiyama; Yasuo Mukunoki; Masakazu Yoneyama, all of Kanagawa, Japan

[73] Assignee: Fuji Photo Film Co., Ltd., Kanagawa, Japan

[21] Appl. No.: 895,456

[22] Filed: Jun. 8, 1992

Related U.S. Application Data

[63] Continuation of Ser. No. 614,416, Nov. 13, 1990, abandoned.

[30] Foreign Application Priority Data

Nov. 14, 1989 [JP] Japan ..... 1-295621

[51] Int. Cl.[5] ..... G03C 1/06

[52] U.S. Cl. ..... 430/637; 430/546

[58] Field of Search ..... 430/527, 546, 637

[56] References Cited

U.S. PATENT DOCUMENTS 4,943,520 7/1990 Yoneyama et al. ..... 430/527
4,999,276 3/1991 Kuwabara et al. ..... 430/264
5,019,491 5/1991 Takeuchi ..... 430/637

FOREIGN PATENT DOCUMENTS 01260437 10/1989 Japan ..... 430/527
02096743 4/1990 Japan ..... 430/637

*Primary Examiner*—Janet C. Baxter
*Attorney, Agent, or Firm*—Sughrue, Mion, Zinn, Macpeak & Seas

[57] ABSTRACT

A silver halide photosensitive material comprising a support having thereon a photosensitive layer comprising at least one silver halide emulsion layer and with a total silver coating amount of silver halide of 2.5 g/m$^2$ or less, and wherein at least one of the layers of the photosensitive material contains a surfactant containing a (poly)glycerol group.

12 Claims, No Drawings

SILVER HALIDE PHOTOSENSITIVE MATERIAL

This is a continuation of application Ser. No. 07/614,416 filed Nov. 13, 1990, now abandoned.

FIELD OF THE INVENTION

This invention relates to a silver halide photosensitive material and, more particularly, it relates to a silver halide photosensitive material which can be processed rapidly with a low silver amount and at a high temperature, such as a microfilm photosensitive material for document copying and a microfilm for a CRT (COM film) photographic material with improved fine image density without irregularity (hereinafter referred to as "water mark" or "water spot") which has been considered to be due to water droplet irregularity during water washing and drying after development processing, particularly after high temperature rapid development processing.

BACKGROUND OF THE INVENTION

With the rapid development of information society, the importance of copying enormous amount of records accumulated over a long period of time rapidly and correctly, and preparing records which will stand up to prolonged storage at low cost, and further recording enormous informations generated as a result of daily economical activities (output information of computers) at high speed, classifying, distributing and storing them for a long time are increasing. Silver halide photosensitive materials occupy an important position as is well known in the art as materials which satisfy these requirements. For example, microfilms for documents (Source Document Microfilm) and COM film (Computer Output Microfilm) are commercially available.

The characteristics required for microfilms and COM films include i) high density recordability (high resolving power) as well as ii) high speed recordability (photographic sensitivity), iii) high speed development processability and iv) permanent storability, etc. Of these characteristics required, silver halide photosensitive materials are quite suitable for items i), ii) and iv), but silver halide photosensitive materials are not necessarily satisfactory for item iii). To overcome this defect, various efforts have been made in the art.

More specifically, to increase the development processing speed, the amount of silver coated has been suppressed to the necessary minimum in designing the photosensitive material. Further, to increase the drying speed after development processing water washing, the amount of a hydrophilic binder (e.g., gelatin) coated on the support is also reduced to the necessary minimum. Moreover, these photosensitive materials, after high temperature development processing, are further quickly dried at a high temperature, and, therefore, if fine water droplet irregularity remains on the surface of the photosensitive material depending on the manner of operation of squeeze rollers or the clearance of squeeze blade of the automatic developing machine, drying irregularity by quick drying thereafter tends to occur. As a result, fine image density irregularity tends to be generated. Some of these image density irregularities can be observed with the naked eye, but these are not under discussion here. Most of the irregularities which pose a problem in microfilms can be observed with the naked eye with extreme difficulty, but could be observed with a loupe. In the field of microphotography, the recorded image is observed enlarged by a factor of 40-fold or more. Even a fine density irregularity not only reduces the finished image quality, but can also result in a deficiency in the recorded information, whereby an extremely serious problem can arise as to its commercial value as microfilm and COM film.

The fine image density irregularity found after development processing drying in microfilm and COM film as mentioned above has been known for a long term, but the mechanism of its generation cannot be said to be sufficiently clarified at this time. I has been believed that fine water droplet irregularity formed after development processing water washing causes drying irregularity to occur when the material is dried quickly at a high temperature, thereby moving image silver particles.

The fine image density irregularity occurring after development processing drying has been long called water marks and also as water spots. The need for a microfilm or COM film in which water marks or water spots are not generated or which are generated only with difficulty even under severe conditions where sufficient control of an automatic developing machine does not occur is great.

SUMMARY OF THE INVENTION

Accordingly, an object of the present invention is to provide a silver halide photosensitive material which is free from generation of fine image density irregularities (water mark or water spot) even after high temperature rapid processing drying as practiced in document microfilm or COM film.

Another object of the present invention is to provide a silver halide photosensitive material which has markedly less image density irregularity after development processing drying without adversely influencing the antistatic property of the photosensitive material both before and after development processing.

Still another object of the present invention is to provide a negative type film without generation of image density irregularity after developing processing.

A further object of the present invention is to provide a positive type COM film for reversal developing processing which is free from generation of image density irregularity after development processing.

A still further object of the present invention is to provide a photosensitive material for direct positive type COM use capable of being processed at a low pH development, e.g., at a pH of 11.5 or lower adapted for rapid processing, in which the generation of image density irregularity after development water washing, drying processing even by a large scale deep tank automatic developing machine for bulk processing, is prevented.

The above objects of the present invention are accomplished by a silver halide photosensitive material having a photosensitive layer comprising at least one silver halide emulsion layer, and having a total coating amount of silver halide of 2.5 $g/m^2$ or less calculated as silver, wherein at least one of the layers of the photosensitive material contains a surfactant having a (poly)-glycerol group.

DETAILED DESCRIPTION OF THE INVENTION

The surfactant having a polyglycerol group which can be advantageously used in the present invention is represented by the formulae (I) and (II).

$$A-X(CH_2\underset{\underset{OH}{|}}{C}HCH_2O)_n-B \quad (I)$$

(II)

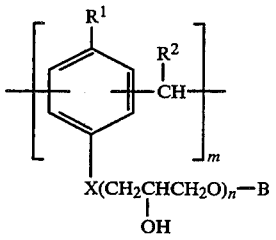

wherein A represents a hydrophobic group necessary for surface activity, specifically an alkyl group, an alkenyl group (preferably having 6 to 12 carbon atoms) or an aralkyl group (preferably having 9 to 24 carbon atoms); X represents a divalent linking group, specifically $$-O-,\ -S-,\ -\underset{\underset{O}{\|}}{C}-O-,\ -\overset{\overset{R_3}{|}}{N}-,\ -\overset{\overset{R_3}{|}}{C}ON-,\ -SO_2\overset{\overset{R_3}{|}}{N}-$$

wherein $R_3$ represents an alkyl group having 1 to 10 carbon atoms $$-(CH_2-\underset{\underset{OH}{|}}{C}HCH_2O)_n-B),$$

which may further contain an alkylene oxide chain; n is 2 to 50, preferably 2 to 20; B represents a hydrogen atom, an alkyl group (preferably having 1 to 8 carbon atoms), a phenyl group or a monovalent group having an anionic group in which any of the alkyl group, phenyl group or monovalent group may contain an alkylene oxide chain; $R^1$ and $R^2$, which may be the same or different, each represents an alkyl group, and preferably $R^1$ represents an alkyl group having from 6 to 18 carbon atoms and $R^2$ represents an alkyl group having from 1 to 6 carbon atoms; and m is 2 to 50.

The alkyl, alkenyl group or aryl group in the formula (I) and the phenyl group in the formula (II) may be further substituted.

Preferred examples of A include

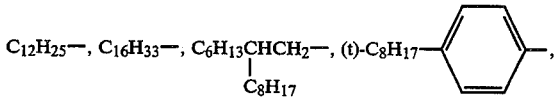

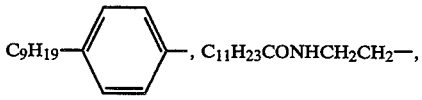

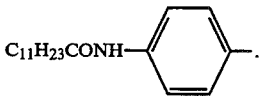

Preferred examples of B include

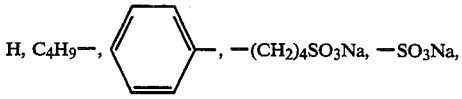

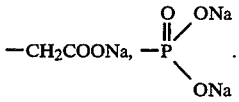

Specific examples of the surfactants having a (poly)-glycerol group which can be used in the present invention are shown below, but the present invention is not to be construed as being limited thereto.

1

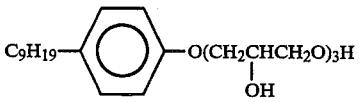

2

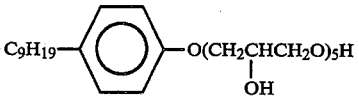

3

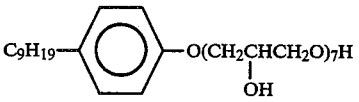

4

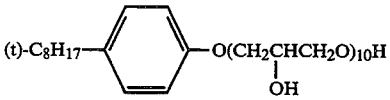

5

$$C_{12}H_{25}O(CH_2\underset{\underset{OH}{|}}{C}HCH_2O)_{10}H$$

6

$$C_{16}H_{33}O(CH_2\underset{\underset{OH}{|}}{C}HCH_2O)_{15}H$$

7

$$C_6H_{13}\underset{\underset{C_8H_{17}}{|}}{C}HCH_2O(CH_2\underset{\underset{OH}{|}}{C}HCH_2O)_{10}H$$

8

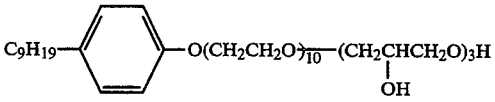

9

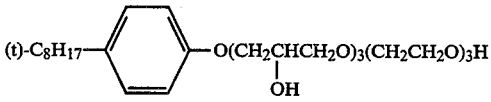

10

$$C_{12}H_{25}-S-(CH_2CH_2O)_{10}(CH_2\underset{\underset{OH}{|}}{C}HCH_2O)_{10}H$$

11

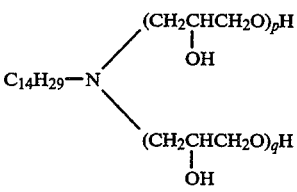

p + q = 10

-continued

12

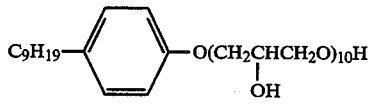

13

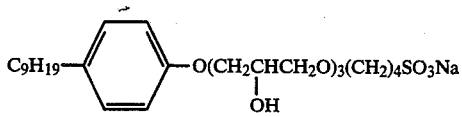

14

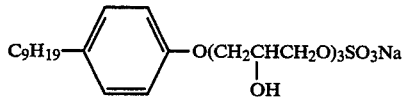

15

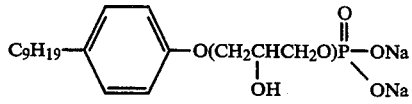

16

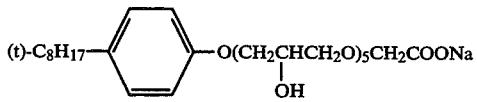

17

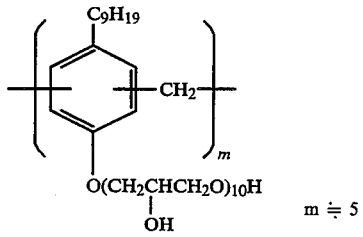

m ≒ 5

18

$C_{12}H_{25}OCH_2CHCH_2O(CH_2CH_2O)_7H$
OH

19

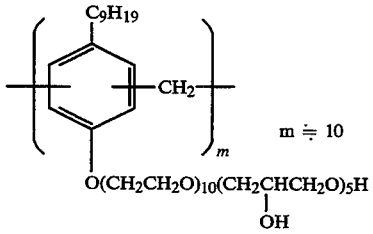

m ≒ 10

20

$C_{16}H_{33}O(CH_2CH_2O)_{10}(CH_2CHCH_2O)_3H$
OH

21

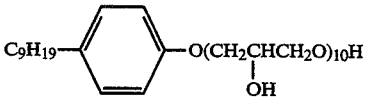

22

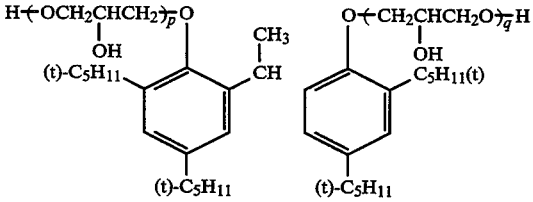

p + q = 25

23

$C_{16}H_{33}O(CH_2CH_2O)_{10}(CH_2CHCH_2O)_6H$
OH

-continued

24

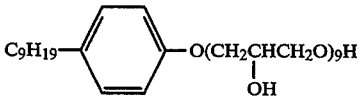

The surfactant having glycerol group which can be used in the present invention can be easily synthesized by conventional methods as described in, for example, U.S. Pat. NO. 4,943,520. For example, synthesis of Compound (1) can be achieved by charging 220 g (1 mol) of nonylphenol as starting material and 5.6 g (0.1 mol) of potassium hydroxide into a three-necked flask, and water as a by-product is removed from the system while heating the mixture under stirring at a temperature of 90° C. Then, while maintaining the temperature at 130° C., 518 g (7 mols) of glycidol are added dropwise thereto. After completion of the dropwise addition, the mixture is further stirred for 2 hours, and then neutralized with concentrated hydrochloric acid (or acetic acid) and filtered to obtain the desired product.

The compound represented by the formulae (I) and (II) may be added to at least one of the silver halide emulsion layers and of the other layers of the photographic photosensitive material. The other layers include preferably hydrophilic colloidal layers, as exemplified by a surfactant protective layer, a backing layer, an intermediate layer, a subbing layer, etc. The addition is particularly preferably to the surface protective layer or the backing layer.

When the surface protective layer or the backing layer comprises two layers, it can be added in either of the layers, or another layer may be also used by overcoating the surface protective layer.

The compound represented by the formulae (I) and (II) to be used in the present invention is dissolved in water or an organic solvent such as methanol, isopropanol, acetone, etc., or a solvent mixture thereof, then this solution is added to a coating solution for the surface protective layer or the backing layer and coated using a method such as dip coating, air knife coating, spraying, or extrusion coating using a hopper as described in U.S. Pat. No. 2,681,294, or alternatively two or more layers can be simultaneously coated or dipped in an antistatic solution according to the methods as described in U.S. Pat. Nos. 3,508,947, 2,941,898, 3,526,528. If desired, a coating on the protective layer may be further provided by coating an antistatic solution containing the compound of the present invention (solution alone or containing a binder).

The compound represented by the formulae (I) and (II) to be used in the present invention is preferably present in an amount of 1 mg to 1,000 mg, particularly 5 mg to 160 mg, per square meter of the photosensitive material.

Two or more of the compounds represented by the formulae (I) and (II) may be also mixed if desired.

The size of the silver halide grain preferably used in the present invention may be 0.1 to 1.0 μm, preferably 0.1 to 0.5 μm, more preferably 0.2 to 0.4 μm, and the overall silver iodide content in the grains is 0 to 5 mol %, preferably 0 to 4 mol %, more preferably 1 to 2 mol %.

The crystal phase may also have a (110) face and/or a (111) face mixed therein, but particularly a (100) face is preferred.

The crystal habit is preferably that of a normal crystal or a single twin, but particularly preferably is that of a normal crystal with respect to monodispersibility.

Here, the crystal phase refers to the outer shape determined by the crystal face forming the surface of the crystal, and the crystal habit refers to the outer shape of the crystal determined by the structure of the crystal.

The silver halide grains of the present invention should be preferably monodispersed grains, but their coefficient of variation (CV) is preferably 20% or less, particularly 5 to 20%, and further 6 to 13%.

The method for preparing the core/shell type grains used in the present invention is not particularly limited, and general preparation methods can be employed. However, preferred preparation conditions for the core are a pAg of 8.0 to 9.2 and a pH of 4.8 to 6.0, while preferred preparation conditions for the shell are a pAg of 6.8 to 7.8 and a pH of 4.8 to 6.0.

The amount of the silver coated in the present invention is preferably 1.0 to 2.5 g/m$^2$.

It is also possible to use a so-called primitive emulsion which is not subjected to chemical sensitization for the silver halide emulsion but ordinarily the emulsion is subjected to chemical sensitization. For chemical sensitization, the methods described in Glafkides, Zelikman et al., or the H. Frieser, ed., *Die Grundlagen der Photographischen Prozesse mit Silberhalogeniden,* Akademische Verlagsgesellschaft (1968) can be employed.

That is, the sulfur sensitization method using compounds such as thiosulfates, thioureas, thiazoles, rhodanines, etc., or active gelatin; the reduction sensitization method using stannous salts, amines, hydrazines, formamidinesulfinic acid, silane compounds, etc.; noble metal sensitization methods using gold complexes or other complexes of metals of the group VIII of the Periodic Table such as platinum, iridium, palladium, etc., either alone or in combination, can be employed.

On the other hand, the grains of the silver halide emulsion of the present invention for direct positive use can be also chemically sensitized internally or the surface of grains can be sensitized by sulfur or selenium sensitization, reducing sensitization, noble metal sensitization, either alone or in combination.

A better direct positive image can be obtained by applying a surface development in the presence of a nucleation agent after image exposure to the silver halide emulsion for direct positive use in the present invention.

Useful nucleation agents which can be present in the emulsion used in the present invention are compounds represented by the following formula (III):

(III)

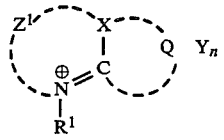

wherein $Z^1$ represents a group of nonmetal atoms necessary for formation of a 5- or 6-membered heterocyclic ring. An aromatic or heterocyclic ring may be further fused to the heterocyclic ring. $R^1$ is an aliphatic group and X is $$=\underset{|}{C}- \text{ or } -\underset{|}{N}-.$$

Q is a 4- to 12-membered non-aromatic hydrocarbon ring or a group of nonmetal atoms necessary for formation of a non-aromatic heterocyclic ring. However, at least one of the substituents on $R^1$, $Z^1$ and Q must contain an alkynyl group. Further, at least one of $R^1$, $Z^1$, and Q may also have a silver halide adsorption promoting group. Y is a counter ion to charge balance, and n is a number necessary to charge balance.

Examples of these compounds and their synthetic methods are described in JP-A-01-224758 (the term "JP-A" as used herein refers to an "unexamined published Japanese patent application") and the patents and literature references cited therein.

Also, thioether compounds, thiomorpholines, quaternary ammonium salt compounds, urethane derivatives, urea derivatives, imidazole derivatives, 3-pyrazolidones, etc., may be also present for the purpose of enhancing sensitivity, contrast, or promoting development. For example, those compounds described in U.S. Pat. Nos. 2,400,532, 2,423,549, 2,716,062, 3,617,280, 3,772,021, 3,808,003, etc., can be used.

Gelatin may be advantageously used as the binder or the protective colloid for the photographic emulsion in the present invention, but also other hydrophilic colloids can be also used.

For example, gelatin derivatives, graft polymers of gelatin with other polymers, proteins such as albumin, casein, etc.; cellulose derivatives such as hydroxyethyl cellulose, carboxymethyl cellulose, cellulose sulfates, etc., saccharide derivatives such as sodium alginate, starch derivatives; a variety of synthetic hydrophilic polymeric materials, such as homo-or copolymers including polyvinyl alcohol, polyvinyl alcohol partial acetal, poly-N-vinyl pyrrolidone, polyacrylic acid, polymethacrylic acid, polyacrylamide, polyvinyl imidazole, polyvinyl pyrazole, etc., can be used.

As the gelatin, in addition to lime-treated gelatin, acid-treated gelatin may be also used, and also gelatin hydrolyzates, gelatin enzyme decomposed products can be also used.

Various known surfactants can be present in the photographic emulsion layers or other hydrophilic colloidal layers in the photosensitive material of the present invention for various purposes such as a coating aid, charging prevention, improvement of slippability, emulsified dispersion, adhesion prevention and improvement of photographic characteristics (e.g., development promotion, tone hardening, and sensitization).

For example, nonionic surfactants such as saponin, glycidol derivatives (e.g., alkenylsuccinic acid polyglyceride, etc.), fatty acid esters of polyhydric alcohols, alkyl esters of sugars, similarly urethanes or ethers; anionic surfactants such as triterpenoid type saponin, alkylcarboxylic acid salts, alkylbenzenesulfonic acid salts, alkylsulfuric acid esters, alkylphosphoric acid esters, N-acyl-N-alkyl-taurines, sulfosuccinic acid esters, sulfoalkyl polyoxyethylene alkylphenyl ethers, etc.; amphoteric surfactants such as amino acids, aminoalkylsulfonic acids, aminoalkylsulfuric acid or phosphoric acid esters, alkylbetaines, amineimides, amine oxides, etc.; cationic surfactants such as alkylamine salts, aliphatic or aromatic quaternary ammonium salts, heterocyclic quaternary ammonium salts such as pyridinium, imidazolium, etc., and aliphatic or heterocyclic ring containing phosphonium or sulfonium salts, etc., can be employed. For antistatic purpose, a fluorine-containing surfactant is preferably used.

The hydrophilic colloid layers such as photographic emulsion layers and other layers can contain a dispersion of a water-insoluble or difficultly soluble synthetic polymer for the purpose of improving dimensional stability, etc., in the photosensitive material of the present invention. For example, polymers comprising, as monomeric components, alkyl (meth)acrylate, alkoxyalkyl (meth)acrylate, glycidyl (meth)acrylate, (meth)acrylamide, a vinyl ester (e.g., vinyl acetate), acrylonitrile, an olefin, styrene, etc., either alone or in combination, or a combination of these with acrylic acid, methacrylic acid, $\alpha,\beta$-unsaturated dicarboxylic acid, hydroxyalkyl (meth)acrylate, sulfoalkyl (meth)acrylate, styrenesulfonic acid, etc., can be employed.

The hydrophilic colloidal layers such as photographic emulsion layers and other layers in the photosensitive material of the present invention may contain inorganic or organic film hardeners. For example, chromium salts (chromium alum, chromic acetate, etc.), aldehydes (formaldehyde, glyoxal, glutaraldehyde, etc.), N-methylol compounds (dimethylolurea, methyloldimethylhydantoin, etc.), dioxane derivatives (2,3-dihydroxydioxane, etc.), active vinyl compounds (1,3,5-triacryloyl-hexahydro-s-triazine, bis(vinylsulfonyl)-methyl ether, etc.), active halogenic compounds (2,4-dichloro-6-hydroxy-s-triazine, etc.), mucohalogenic acids (mucochloric acid, mucophenoxychloric acid, etc.), isooxazoles, dialdehyde starch, 2-chloro-6-hydroxytriazinylated gelatin, etc., can be used alone or in combination.

The photographic emulsion of the present invention may also be spectrally sensitized with methine dyes and other dyes. Examples of dyes which can be used may include cyanine dyes, merocyanine dyes, complex cyanine dyes, complex merocyanine dyes, holopolar cyanine dyes, hemicyanine dyes, styryl dyes, and hemioxonol dyes. Particularly useful dyes are merocyanine dyes, and complex merocyanine dyes. Any of the nuclei conventionally utilized as basic heterocyclic rings in cyanine dyes can be present in these dyes. More specifically, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; nuclei having an alicyclic hydrocarbon ring fused to these nuclei; and nuclei having an aromatic hydrocarbon ring fused to these nuclei, namely, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., may be present in these dyes. The carbon atoms of these nuclei may also be substituted.

The merocyanine dyes or complex merocyanine dyes may contain as a nucleus having a ketomethylene structure a 5- or 6-membered heterocyclic ring such as a pyrazoline-5-one nucleus, a thiohydantoin nucleus, a 2-thiooxazolidine-2,4-dione nucleus, nucleus, a thiazolidine-2,4-dione nucleus, a rhodanine nucleus, a thiobarbituric acid nucleus, etc.

The hydrophilic colloidal layers in the photosensitive material of the present invention may contain a filter dye, or water-soluble dyes (an oxonol dye, a hemioxonol dye, a styryl dye, a merocyanine dye, a cyanine dye and an azo dye, etc.) for irradiation prevention and other various purposes.

The silver halide photosensitive material of the present invention may contain known antifoggants or stabilizers. Examples of antifoggants or stabilizers which can be present include mercapto compounds, benzothiazolium salts, nitroindazoles, nitrobenzimidazole, chlorobenzimidazoles, bromobenzimidazoles, aminotriazoles, benzotriazoles, nitrobenzotriazoles, benzenethiosulfonic acids, benzenesulfinic acids, benzenesulfonic acid amides, azaindenes (e.g., triazaindenes, tetraazaindenes (particularly 4-hydroxy-substituted (1,3,3a,7)tetraazaindenes)), etc.

The silver halide photosensitive material of the present invention may also contain two or more silver halide emulsion layers, and may further have a surface protective layer, an intermediate layer, a halation preventive layer, a backing layer, etc.

Particularly, the photosensitive material should preferably have a dyed gelatin layer between the silver halide emulsion layers and the support.

Such a gelatin layer can contain, in addition to gelatin, hydroquinone and its derivatives, resorcin, catechol, DIR hydroquinones, etc., and its film thickness is preferably 0.5 to 1.5 $\mu$m.

It is preferable to incorporate an antistatic agent, a matting agent, etc., in the backing layer of the photosensitive material.

Preferred antistatic agents are electroconductive metal oxide fine particles (e.g., $SnO_2$ doped with antimony, etc.), fluorine containing surfactants, electroconductive polymers, etc., while preferred matting agents are PMMP with particle sizes of 1 to 10 $\mu$m, barium-strontium sulfate, $SiO_2$), etc.

Exposure to obtain a photographic image in the present invention may be achieved using conventional methods. That is to say, any of a variety of known light sources such as natural light (sun), a tungsten lamp, a fluorescent lamp, a mercury lamp, a xenon arc lamp, a carbon arc lamp, a xenon flash lamp, cathode ray tube flying spot, etc., can be used. For the exposure time, of course an exposure time from 1/1,000 second to 1 second ordinarily used in cameras, or exposure shorter than 1/1,000 second, for example, exposure for $1/10^4$ to $1/10^6$ second using a xenon flash lamp or a cathode ray tube can be employed, and also an exposure longer than 1 second can be employed.

Any of the development processing methods to form positive type silver image by reversal development known in the art can be employed for the photographic processing of the photosensitive material of the present invention. Known processing solutions can be used. The processing temperature is ordinarily chosen at between 18° C. and 65° C., but the temperature used may be also a temperature lower than 18° C. or higher than 65° C.

The reversal development processing ordinarily comprises the following steps:

First developing, water washing, bleaching, cleaning, overall surface exposure, second developing, fixing, water washing, and drying.

The developer which can be used for the black-and-white photographic processing in the first developing can contain known developing agents. Suitable developing agent which can be employed, alone or in combination, include dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolines, ascorbic acid, and heterocyclic compounds having a 1,2,3,4-tetrahydroquinoline ring and an indolene ring fused to each other as described in U.S. Pat. No. 4,067,872. Particularly, it is preferable to use pyrazolidones and/or aminophenols in combination with dihydroxybenzenes. The developer generally contains, in addition to these compounds, an alkali agent, a pH buffer and an antifoggant, and may further contain, if desired, a dissolving aid, a toning agent, a developing accelerator, a surfactant, a defoaming agent, a hard water softener, a film hardener, a viscosity imparting agent, etc. The photosensitive material of the present invention is ordinarily processed with a developer containing 0.15 mol/liter or more of sulfite ions as a preservative.

The pH is preferably 9 to 11, particularly preferably 9.5 to 10.5.

For the first developer, 0.5 to 6 g/liter of a solvent for silver halide, such as NaSCN, may be employed.

For the second developer, a black-and-white developing processing solution in general can be used. That is, the second developer has the composition of the first developer but without the solvent for silver halide. The pH of the second developer is preferably 9 to 11, particularly preferably 9.5 to 10.5.

A bleaching agent such as potassium bichromate or cerium sulfate may be employed for the bleaching solution.

A thiosulfate, a thiocyanate is preferably employed for the fixing solution and the fixing solution may also contain a water-soluble aluminum salt, if desired.

Heretofore, a shortening of the development processing time and further a simplification of the processing, particularly a simplification of reversal processing, have been important tasks for a photosensitive material such as a microfilm. The compound represented by the formulae (I) and (II) of the present invention can provide an extremely excellent photosensitive material also for microfilm systems and their processing.

The present invention is described by way of the following examples but the present invention is not to be construed as being limited thereto at all. Unless otherwise indicated herein, all parts, percents, ratios and the like are by weight.

EXAMPLE 1

1. Preparation of Original Emulsion to be Used in the Present Invention

Two kinds of Original Emulsions #1 and #2 were prepared using the methods as described below. Original Emulsion #1 is a surface latent image type emulsion, and negative type characteristics can be obtained with a commercially available general purpose microfilm processing solution. Further, by reversal treatment using a reversal processing solution, positive type characteristics are obtained.

Original Emulsion #2 is a core/shell type internal latent image type emulsion, and positive images are directly obtained by a single development using a general purpose microfilm processing solution in combination with a nucleation agent.

| Preparation of Original Emulsion #1 | |
|---|---|
| Solution I 75° C. | |
| Inert Gelatin | 24 g |
| Distilled Water | 900 ml |
| KBr | 4 g |

-continued

| Preparation of Original Emulsion #1 | |
|---|---|
| Aqueous Phosphoric Acid (10% aq. soln.) | 2 ml |
| Sodium Benzenesulfinate | $5 \times 10^{-2}$ mol |
| 2-Mercapto-3,4-methylthiazole | $2.5 \times 10^{-3}$ g |
| Solution II 35° C. | |
| Silver Nitrate | 170 g |
| Distilled Water Added to | 1,000 ml |
| Solution III 35° C. | |
| KBr | 230 g |
| Distilled Water Added to | 1,000 ml |
| Solution IV Room Temperature | |
| Potassium Hexacyanoferrate (II) | 0.03 g |
| Distilled Water Added to | 100 ml |

Solution II and Solution III were added at the same time over a 45 minute period to well stirred Solution I, and at the point when the entire amount of Solution II had been added, a cubic monodispersed emulsion with an average grain size of 0.28 μm was obtained.

At this time, Solution III was added at an addition rate controlled relative to the addition to Solution II so that the pAg value in the mixing vessel was constant at 7.50. Solution IV was added 7 minutes after initiation of the addition of Solution II over a 5 minute period. After completion of the addition of Solution II, subsequently the mixture was washed with water and desalted by sedimentation, followed by dispersion into an aqueous solution containing 100 g of inert gelatin. Into the emulsion were added 34 mg of each of sodium thiosulfate and chloroauric acid tetrahydrate per mol of silver, and the pH and pAg were adjusted respectively to 8.9 and 7.0 (40° C.) before chemical sensitization treatment at 75° C. for 60 minutes to obtain a surface latent type silver halide emulsion (Original Emulsion #1).

Preparation of Original Emulsion #2

The same solutions used in preparation of Original Emulsion #1 were employed. However, the following differences existed.

Solution II and Solution III were added at the same time over a 5 minute period to Solution I, and when octahedral particles with an average grain size of 0.10 μm were formed, addition of Solution II, Solution III was temporarily stopped, and 115 mg of each of sodium thiosulfate and chloroauric acid tetrahydrate per mol of silver were added, followed subsequently by a chemical sensitization treatment at 75° C. for 60 minutes. To the core grains chemically sensitized thus obtained, simultaneous addition of Solution II and Solution III was continued again, and Solution IV was added 5 minutes after the recommencement of the addition of Solution II over a 5 minute period, and the entire amount of Solution II was added at 75° C. over a 40 minute period while controlling the addition rate of Solution III so that the pAg of the mixture was 7.50. Thus, a cubic core/shell emulsion with an average particle size of 0.28 μm was finally obtained. The operations after water washing and desalting were entirely the same as in the preparation of Original Emulsion #1. Thus, an internal latent image type cubic core/shell emulsion with a chemically sensitized surface was obtained (Original Emulsion #2).

2. Preparation of Test Coated Products

Using Original Emulsions #1 and #2, 16 kinds in total of test coated products (IA–IH, IIA–IIH) were prepared as shown in Table 1 below.

TABLE 1

| Original Emulsion | Nucleation Agent | Amount of Compound of the Present Invention Added in the Protective Layer | | | | | | | |
|---|---|---|---|---|---|---|---|---|---|
| | | A | B | C | D | E | F | G | H |
| I (#1) | None | None | 5 | 10 | 15 | 20 | 40 | 80 | 160 |
| II (#2) | Compound (a) | None | 5 | 10 | 15 | 20 | 40 | 80 | 160 |

A–H are coating amounts, and the amount added is in mg/m$^2$

These coated samples were all prepared under the same conditions except for the original emulsion used, the presence or absence of nucleation agent and the amount of the compound of the present invention added to the protective layer. The layer constitution and the composition of the respective layers are as shown below.

| | Film Thickness (μm) |
|---|---|
| Layer Constitution | |
| (i) Protective Layer | 1.0 |
| (ii) Emulsion Layer | 2.0 |
| Support | 100 μm |
| (iii) Electroconductive Backing Layer | 0.2 |
| (iv) Dye Backing Layer | 1.4 |
| Protective Layer | |
| Inert Gelatin | 1,300 mg/m$^2$ |
| Colloidal Silica | 249 |
| Liquid Paraffin | 60 |
| Barium Strontium Sulfate (average particle size: 1.5 μm) | 32 |
| Proxel | 4.3 |
| N-Perfluorooctanesulfonyl-N-propylglycine Potassium Salt | 5.0 |
| 1,3-Bisvinylsulfonyl-2-propanol | 56 |
| Compound of the Present Invention (Compound 1, or 2, or 3) | Amount Added Listed in Table 1 |
| Reference Compound: | |

-continued

| | Film Thickness (μm) |
|---|---|
| 1 (sodium dodecylbenzenesulfonate) | Amount Added Listed in Table 1 |
| 2 (sucrose type Compound III) | Amount Added Listed in Table 1 |
| Emulsion Layer | |
| Silver Halide Emulsion (as silver amount) | 1,700 mg/m$^2$ |
| Nucleating Agent (Compound (a)) | 0.0394 |
| Sensitizing Dye (Compound (b)) | 23.8 |
| 5-Methylbenzotriazole | 4.1 |
| Sodium Dodecylbenzenesulfonate | 5 |
| 1,3-Bisvinylsulfonyl-2-propanol | 56 |
| Sodium Polystyrenesulfonate | 35 |
| Electroconductive Backing Layer | |
| $SnO_2$/Sb (9/1 weight ratio, (average grain size: 0.25 μm) | 300 mg/m$^2$ |
| Inert Gelatin | 170 |
| Proxel | 7 |
| Sodium Dodecylbenzenesulfonate | 10 |
| Sodium Dihexyl-α-sulfosuccinate | 40 |
| Sodium Polystyrenesulfonate | 9 |
| Dye Backing Layer | |
| Inert Gelatin | 1,580 mg/m$^2$ |
| Dye (Compound (c)) | 72 |
| Barium Strontium Sulfate (average particle size: 1.5 μm) | 50 |
| Liquid Paraffin | 60 |
| N-Perfluorooctanesulfonyl-N-propylglycine Potassium | 5 |
| Sodium Dodecylbenzenesulfonate | 9 |
| Sodium Dihexyl-α-sulfonsuccinate | 34 |
| Sodium Polystyrenesulfonate | 4 |
| Proxel | 5 |

Support

Polyethylene terephthalate film with subbing layers on both surfaces (100 μm thickness)

Nucleating Agent (a)

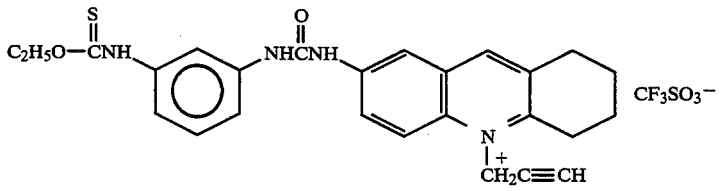

Spectral Sensitizing Dye (b)

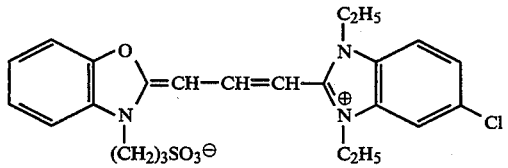

Backing Dye (c)

-continued

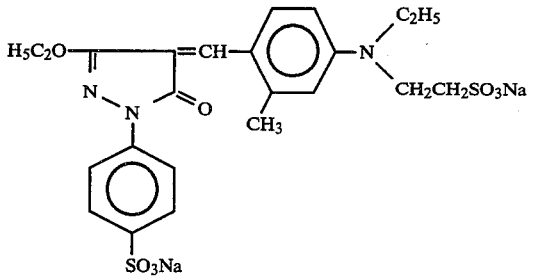

Compound III

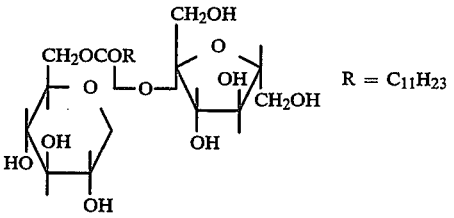

3. Exposure and Developing Method of Coated Samples and Evaluation of Appearance of Water Spot (a) Imagewise Exposure Imagewise exposure was effected using a MARK-II xenon flash sensitometer manufactured by E.G. & G. Co., U.S.A. through a continuous density wedge for $10^{-3}$ sec. under a safety lamp from the emulsion coated surface.

(b) Reversal Development Processing

Reversal development processing was performed using a deep tank automatic developing machine for F-10R reversal manufactured by Allen Products, U.S.A. employing commercially available processing solution for reversal (FR-531, 532, 533, 534, 535 manufactured by FR Chemicals Co., U.S.A.) under the following conditions.

| | | Reversal Development Conditions: | | | |
|---|---|---|---|---|---|
| | | Run No. 1 | | Run No. 2 | |
| Step | Processing Solution | Temperature (°C.) | Time (sec) | Temperature (°C.) | Time (sec) |
| 1. First Developing | FR-531 (1:3) | 35 | 30 | 43 | 15 |
| 2. Water Washing | Running Water | " | " | " | " |
| 3. Bleaching | FR-532 (1:3) | " | " | " | " |
| 4. Cleaning | FR-533 (1:3) | " | " | " | " |
| 5. Light Exposure | — | — | — | — | — |
| 6. Second Developing | FR-534 (1:3) | " | " | " | " |
| 7. Fixing | FR-535 (1:3) | " | " | " | " |
| 8. Water Washing | Spraying | " | " | " | " |
| 9. Drying | Hot Air | — | — | — | — |

(c) Negative Development Processing and Direct Reversal Development Processing

Both negative development processing and direct reversal development processing were carried out in an F-10 deep tank automatic developing machine manufactured by Allen Products, U.S.A., using a commercially available general purpose microfilm processing solution (FR-537 developer manufactured by FR Chemicals, U.S.A.) under the following conditions.

| | | Run No. 1 | | Run No. 2 | |
|---|---|---|---|---|---|
| Step | Processing Solution | Temperature (°C.) | Time (sec) | Temperature (°C.) | Time (sec) |
| 1. Developing | FR-537 (1:3) | 35 | 30 | 43 | 15 |
| 2. Water Washing | Running Water | " | " | " | " |
| 3. Fixing | FR-535 (1:3) | " | " | " | " |
| 4. Water Washing | Spraying | " | " | " | " |
| 5. Drying | Hot Air | — | — | — | — |

(d) Evaluation of Appearance of Water Spot

Evaluation of appearance of water spots of the respective sensitive materials using various processing solutions was performed according to the two methods as described below (1. real machine compulsory testing and 2. contact angle measurement after processing).

1. Real Machine Testing under Compulsory Conditions with an Automatic Developing Machine (Allen F10-R and F10)

To demonstrate the effectiveness of the compound of the present invention more clearly, the critical condition test for exhibiting compulsorily water spots was practiced using a comparative sample (sample in which no compound of the invention was added). More specifically, the clearance of squeeze blade of the above-mentioned automatic developing machine was expanded and the drying air amount was increased to carry out the evaluation, and the water spot appearance critical condition of the comparative sample was determined. The tests for the effectiveness of the compounds of the present invention were performed under compulsory conditions where water spotting was clearly exhibited with the comparative sample, and the blackened density at around 0.5 of the sample exposed through a continuous wedge was observed, whereby the presence or absence of blackened blackness irregularity was evaluated.

2. Measurement of Contact Angle of Sample with Water after Development Processing and Drying The contact angle of the above sample with water was measured using a measuring instrument, and the corresponding relationship to the compulsory test results using a real machine was examined. The contact with water after processing was found to be a critical angle of 55° in the case of Allen F-10 and F10-R automatic developing machine. In other words, it has been found that the risk of appearance of water spots is high when the contact angle with water is 55° or higher.

The contact angle was measured under the following conditions.

Measuring Instrument:

Manufactured by Kyowa Kaimenkagaku K.K., contact angle measuring device Model CA-A Measuring Conditions:

Room temperature (25° C.±3° C.), measured 40 seconds after dropwise addition of distilled water The relationship between the kind/amount added of the surfactant and generation of water spots (surfactants were all added to the protective layer) are shown in Tables 2 and 3 below.

TABLE 2

| | Generation of Water Spots* Sample | | | | | | | |
|---|---|---|---|---|---|---|---|---|
| | A | B | C | D | E | F | G | H |
| Amount Added (mg/m²) | — | 5 | 10 | 15 | 20 | 40 | 80 | 160 |
| Surfactant | | | | | | | | |
| 1 (sodium dodecylbenzenesulfonate) | x | x | x | x | x | x | x | x |
| 2 (Compound III) | x | x | x | x | x | x | x | Δ |
| 3 (Compound 1 of the invention) | x | Δ | ○ | ○ | ○ | ○ | ○ | ○ |
| (Compound 2 of the invention) | x | x | Δ | ○ | ○ | ○ | ○ | ○ |
| (Compound 3 of the invention) | x | x | Δ | ○ | ○ | ○ | ○ | ○ |

*x: Water spots generated, Δ: Substantially none, ○: Entirely none

TABLE 3

| | Contact Angle with Water (room temperature, 40 sec. after drop addition) Sample | | | | | | | |
|---|---|---|---|---|---|---|---|---|
| | A | B | C | D | E | F | G | H |
| Amount Added (mg/m²) | — | 5 | 10 | 15 | 20 | 40 | 80 | 160 |
| Surfactant | | | | | | | | |
| 1 (sodium dodecylbenzenesulfonate) | 65 | 65 | 65 | 65 | 65 | 65 | 62 | 59 |
| 2 (Compound III) | 65 | 65 | 65 | 65 | 65 | 65 | 60 | 59 |
| 3 (Compound 1 of the invention) | 65 | 56 | 51 | 46 | 43 | 37 | 31 | 30 |
| (Compound 2 of the invention) | 65 | 63 | 57 | 52 | 45 | 39 | 30 | 30 |
| (Compound 3 of the invention) | 65 | 61 | 55 | 53 | 46 | 38 | 32 | 30 |

As is apparent from the above results, the sample in which the surfactant of the present invention is added in a certain amount (10 mg or more) has been confirmed to be completely free from the generation of water spots, regardless of the kind of development processing (i. negative developing, ii. reversal developing, iii. direct reversal developing), even when rapid processing (developing time: 13 seconds) at high temperature (43° C.) using a deep tank automatic developing machine is conducted. When no surfactant of the present invention was contained, or when a surfactant not in accordance with the present invention was employed, water spots were markedly generated. From this, it can be seen that the surfactant of the present invention is quite effective for prevention of water mark generation.

While the invention has been described in detail and with reference to specific embodiments thereof, it will be apparent to one skilled in the art that various changes and modifications can be made therein without departing from the spirit and scope thereof.

What is claimed is:

1. A silver halide photosensitive material comprising a support having thereon a photosensitive layer, said photosensitive layer comprising at least one silver halide emulsion layer, wherein said photosensitive material has a total silver coating amount of silver halide of 2.5 g/m² or less, and wherein said photosensitive material contains a surfactant containing a (poly)glycerol group represented by formula (I) or formula (II):

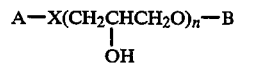

(I)

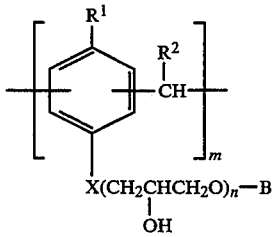

(II)

wherein A represents an unsubstituted alkyl group, an alkenyl group, an aralkyl group;

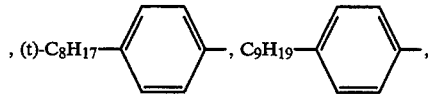

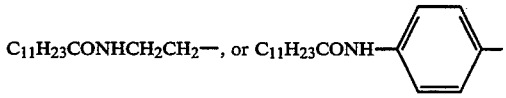

X represents

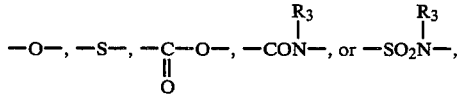

wherein $R_3$ represents either an alkyl group having 1 to 10 carbon atoms or

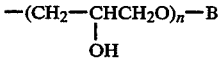

and wherein —O— and —S— to $$(CH_2\underset{\underset{OH}{|}}{C}HCH_2O)_n$$

can be bonded via an alkylene oxide chain; B represents a hydrogen atom, an alkyl group having 1 to 8 carbon atoms, a phenyl group, or another monovalent group having an anionic substituent, and any of the alkyl group, phenyl group or monovalent group may contain an alkylene oxide chain; $R^1$ and $R^2$, which may be the same or different, each represents an alkyl group; m is 2 to 50; and n is 2 to 50.

2. The silver halide photosensitive material of claim 1, wherein the surfactant containing a (poly)glycerol group is present in said photographic photosensitive material in an amount of 1 mg to 1,000 mg/$m^2$ of said photographic photosensitive material.

3. The silver halide photosensitive material of claim 1, wherein the grains of the silver halide have a size of 0.1 to 1.0 $\mu$m.

4. The silver halide photosensitive material of claim 1, wherein the silver halide contains an overall silver iodide content of 0 to 5 mol % of the silver halide present.

5. The silver halide photosensitive material of claim 1, wherein the alkenyl group has 6 to 12 carbon atoms.

6. The silver halide photosensitive material of claim 1, wherein the aralkyl group has 9 to 24 carbon atoms.

7. The silver halide photosensitive material of claim 1, wherein n is 2 to 20.

8. The silver halide photosensitive material of claim 1, wherein $R^1$ represents an alkyl group having from 6 to 18 carbon atoms and $R^2$ represents an alkyl group having from 1 to 6 carbon atoms.

9. The silver halide photosensitive material of claim 1, wherein A is selected from the group consisting of

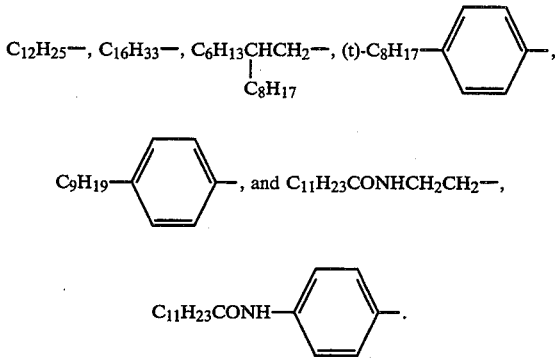

10. The silver halide photosensitive material of claim 1, wherein B is selected from the group consisting of

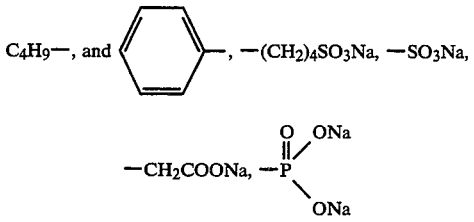

11. The silver halide photosensitive material of claim 1, wherein said photosensitive material further comprises at least one layer other an said at least one silver halide emulsion layer.

12. The silver halide photosensitive material of claim 11, wherein the surfactant containing a (poly)glycerol group is present in said at least one silver halide emulsion layer or in said at least one layer other than said at least one silver halide emulsion layer.

* * * * *